United States Patent [19]

Dingler et al.

[11] 4,350,306

[45] Sep. 21, 1982

[54] CHOPPER FOR DISHWASHER SOIL SEPARATOR

[75] Inventors: Geoffrey L. Dingler; Wilbur W. Jarvis, both of St. Joseph Township, Berrien County; Raymond W. Spiegel, Lincoln Township, Berrien County, all of Mich.

[73] Assignee: Whirlpool Corporation, Benton Harbor, Mich.

[21] Appl. No.: 189,784

[22] Filed: Sep. 22, 1980

[51] Int. Cl.[3] ..... B02C 18/10

[52] U.S. Cl. ..... 241/46.15; 134/115 G; 241/257 G; 241/292.1

[58] Field of Search ..... 241/46.17, 46 B, 257 R, 241/257 G, 292.1; 134/115 G; 415/121 B, 121 G

[56] References Cited

U.S. PATENT DOCUMENTS

| | | | |
|---|---|---|---|
| 1,480,969 | 1/1924 | Thomson | 241/21 |
| 1,971,588 | 8/1934 | Stoddard et al. | 141/9 |
| 2,664,965 | 1/1954 | Moore | 183/91 |
| 3,023,757 | 3/1962 | Mixon | 134/99 |
| 3,310,243 | 3/1967 | Duncan et al. | 241/101 |
| 3,313,311 | 4/1967 | Gilson | 134/109 |
| 3,364,860 | 1/1968 | Schmitt-Matzen | 103/3 |
| 3,370,598 | 2/1968 | Lopp | 134/111 |
| 3,434,671 | 3/1969 | Cushing et al. | 241/46 |
| 3,807,419 | 4/1974 | Cushing et al. | 134/104 |
| 3,981,456 | 9/1976 | Hahn et al. | 241/46 R |
| 4,143,993 | 3/1979 | Blum | 415/121 B |
| 4,150,680 | 4/1979 | Johnson et al. | 134/104 |
| 4,168,715 | 9/1979 | Spiegel et al. | 134/104 |
| 4,201,345 | 5/1980 | Ziegler | 241/46 R |

*Primary Examiner*—Eugene F. Desmond

*Attorney, Agent, or Firm*—Wegner, McCord, Wood & Dalton

[57] ABSTRACT

A dishwasher structure having a centrifugal pump for providing dishwashing liquid to a spray arm thereof. The swirling motion of the dishwashing liquid effected by operation of the pump is utilized to divert a portion of the liquid to an accumulator wherein soil material is collected from the liquid. The cleansed liquid is returned to the pump chamber to be repumped with additional dishwashing liquid. The soil accumulating chamber is arranged concentrically about a guide chamber, in turn arranged concentrically about the pump chamber to provide a compact coaxial liquid cleansing structure. A drain is provided for draining the dishwashing liquid and collected soil at the end of the dishwashing cycle. A filter screen is provided at the inlet to the pump and an improved chopper is provided for comminuting solid soil matter at the upstream side of the filter screen.

12 Claims, 7 Drawing Figures

FIG. 4
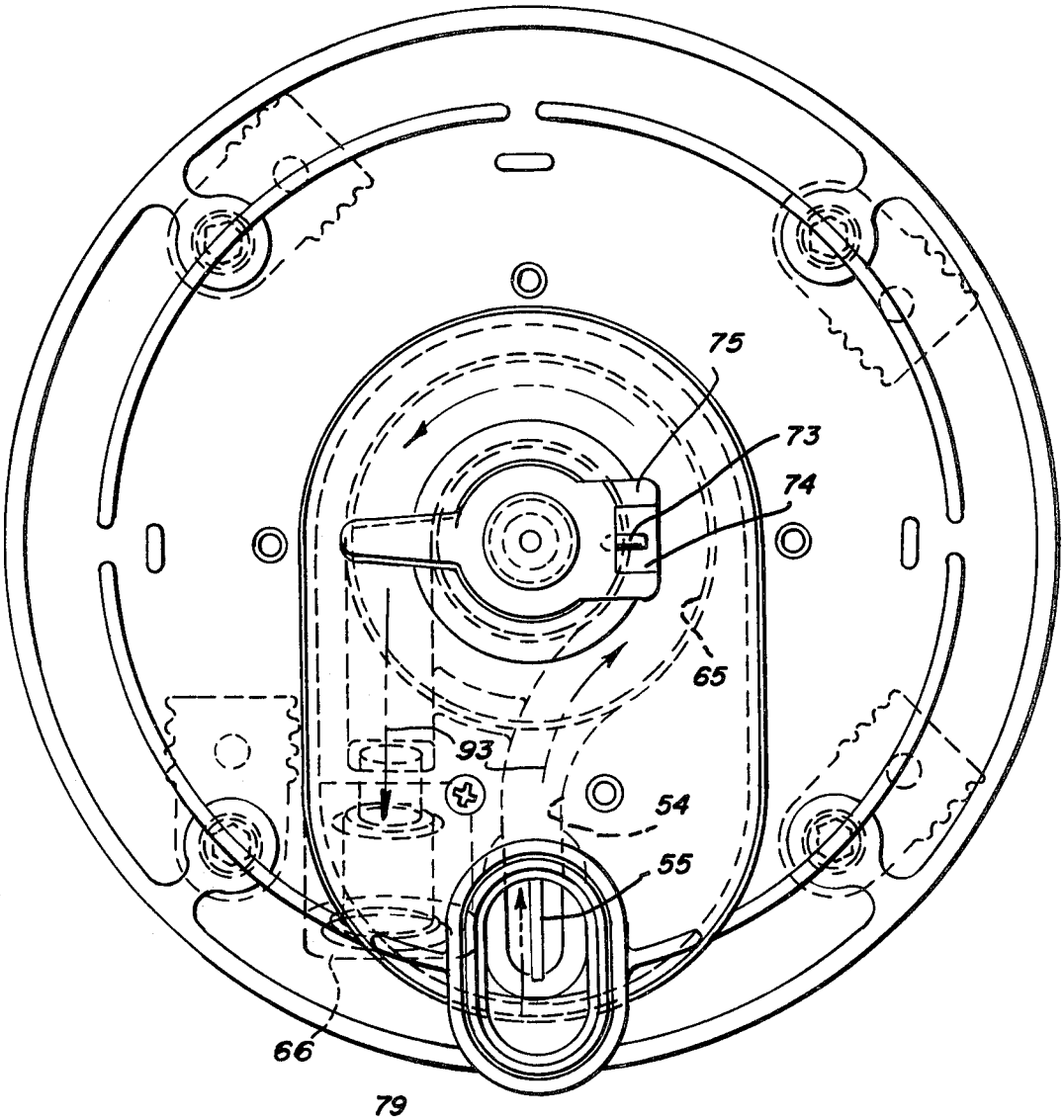
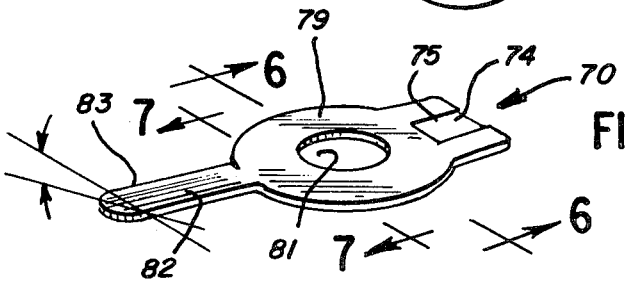
FIG. 5

CHOPPER FOR DISHWASHER SOIL SEPARATOR

BACKGROUND OF THE INVENTION

1. Field of the Invention

This invention relates to soil separator means of a dishwasher apparatus and in particular to means for comminuting solid soil matter in the dishwashing liquid for improved circulation of the dishwashing liquid during a dishwashing operation.

2. Description of the Background Art

In one form of dishwasher disclosed in U.S. Pat. No. 4,150,680 of Philip P. Johnson et al, which patent is owned by the assignee hereof, an improved structure for separating food soil and the like from the dishwashing liquid is disclosed. The structure is arranged to utilize the combined swirling and longitudinal movement of the dishwashing liquid in the suction passage to the circulation pump for effecting circulation of a portion of the liquid through a soil accumulator having a return passage leading back to the suction portion of the dishwasher liquid circulation means. An impeller is provided in the suction passage for swirling the liquid at relatively high speed to effect the desired transfer of a portion thereof to the soil separating means.

In U.S. Pat. No. 4,168,715 of Raymond W. Spiegel et al, which patent is also owned by the assignee hereof, another form of soil separator is disclosed in a dishwasher structure wherein the soil separating structure is associated with the suction passage leading to the circulation pump. This structure is arranged to utilize the combined swirling and longitudinal movement of the dishwashing liquid in the suction passage produced by a rotary impeller generally similar to that of the above discussed Johnson et al patent. By suitably arranging ports communicating between the suction passage and the separator, the circulation of a portion of the liquid through the separator is automatically effected. More specifically, as disclosed in the Spiegel et al patent, the swirling liquid in the suction passage is urged outwardly from the suction passage through a radially outwardly disposed port and back into the suction passage through a radially inwardly disposed port as a result of the pressure differential resulting from the different radial spacings of the port from the axis of the swirling means.

Another form of soil separator is illustrated in U.S. Pat. No. 1,971,588 of E. S. Stoddard et al. As shown therein, the drain pump is arranged to receive heavier soil particles from the tub sump and force them outwardly into the drain conduit which is normally closed by a valve 91. When the valve is opened, the pump drains the dishwashing machine by pumping the liquid from the bottom portion thereof outwardly through the drain so as to carry with the liquid being drained the soil particles previously delivered to the drain conduit. The drain pump is disposed below the sump, whereas the main liquid circulating impeller is disposed at the bottom wall of the tub.

In U.S. Pat. No. 3,434,671 of Donald S. Cushing et al, a dishwasher pump structure is shown which is provided with an inlet having a grating member including a grid. The size of the openings of the grid are related to the size of the orifices in the spray arm so that particles passing through the grid will pass through the orifices of the spray arms without clogging them. A blade is rotated by the pump adjacent the grating member so as to macerate any food particles trapped thereon until they are small enough to pass through the opening. The blade is pivotally mounted so that if an article is stuck in one of the openings of the grid member, the shaft and projection rotate without damage to either while the blade rides against the obstruction in a reciprocating manner. Where the particle is too large to go through or become lodged in the opening, the blade bats the particle around until it finds its way into a receiving chamber for discharge with the dishwashing liquid when the drain cycle is initiated. The blade preferably does not have a sharpened leading edge, but relies on a small thickness of the edge to macerate the food particles.

Thomas N. Hahn et al, in U.S. Pat. No. 3,981,456, shows another form of food particle macerating means wherein a cutting arm is attached to a helically wound column. The arm is rotated adjacent a grating element. Thus, the cutting arm is capable of riding over or slipping around unmacerable food particles, such as particles of bone, which may become caught in the grid openings. The macerating device is further arranged to dislodge unmacerable particles from the grating element and urge them into a trap for their subsequent collection. In the illustrated embodiment, the macerating device comprises the distal turned end of a helically wound wire.

SUMMARY OF THE INVENTION

The present invention comprehends an improved comminuting means for use in a dishwasher or the like to effect improved circulation of the dishwashing liquid during the dishwashing operation.

More specifically, the comminuting means includes a hub, means for rotating the hub about an axis perpendicular to the surface of the filter screen, and a chopping blade carried by the hub and defining a cutting edge extending outwardly from the hub substantially parallel to the screen. The blade is turned relative to a plane parallel to the axis of rotation to define means for causing turbulent agitation of the liquid immediately upstream of the screen for preventing adherence of large size solid material to the upstream side of the screen.

Thus, the improved comminuting means chops large size food particles caused to be agitated by the turned blade construction as the blade is swung annularly about the axis of rotation of the rotating hub.

In the illustrated embodiment, the chopper blade is substantially planar.

The hub portion of the chopper, in the illustrated embodiment, comprises a flat disc, the cutting edge being spaced from the plane of the disc.

In the illustrated embodiment, the blade extends radially to the axis of rotation of the hub.

The means for rotating the hub in the present invention comprises a drive shaft and means for yieldably mounting the hub to the drive shaft.

The yieldable mounting of the hub to the drive shaft effectively reduces shock forces tending to break the blade resulting from impact of the blade with the hard solid material to be cut.

In the illustrated embodiment, the yieldable mounting means comprises a coil spring disposed coaxially of the drive shaft and having an upper distal end connected to the hub and a lower distal end driven by the shaft.

In the illustrated embodiment, the hub is provided with means defining an outwardly extending deformed wall portion or groove with the end portion of the spring being retained in the opening provided by the deformed wall.

Furthermore specifically, in the illustrated embodiment, the groove is defined by a tongue extending outwardly from the hub. The groove opens at its inner end to the space adjacent one face of the hub.

In the illustrated embodiment, the channel is V-shaped.

Thus, the dishwashing soil separating means of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 4 is an enlarged transverse section taken substantially along the line 4—4 of FIG. 2;

FIG. 5 is a perspective view of the soil chopper thereof;

DESCRIPTION OF THE PREFERRED EMBODIMENT

Figure 2:
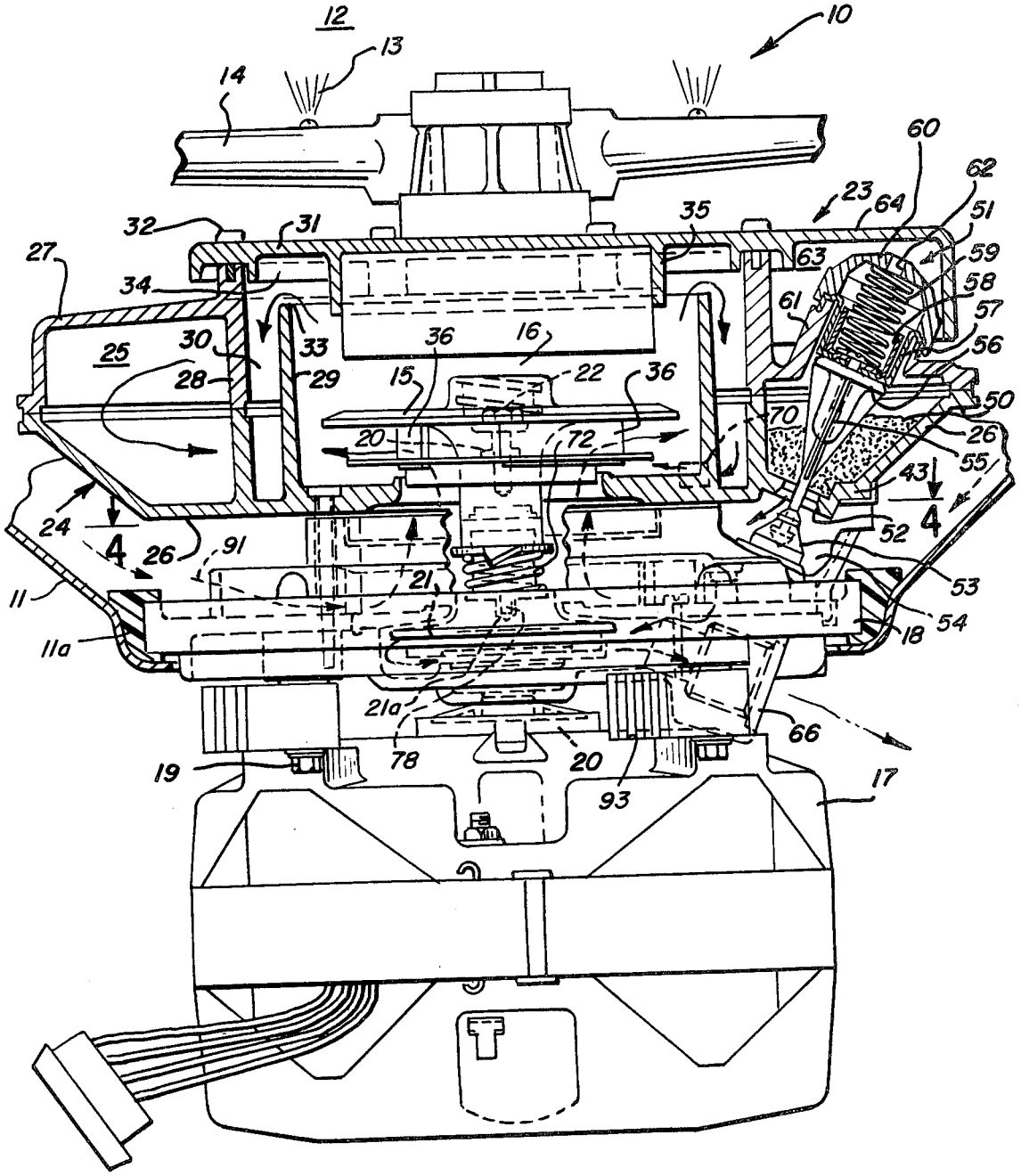
FIG. 2 is a diametric section thereof taken substantially along the line 2—2 of FIG. 1.

In the exemplary embodiment of the invention as disclosed in the drawings, and particularly FIG. 2, a dishwashing apparatus generally designated 10 is shown to comprise a tub 11 defining a dishwashing space 12 in which dishes are retained to be washed by jets 13 of washing liquid delivered through a spray arm 14.

Figure 1:
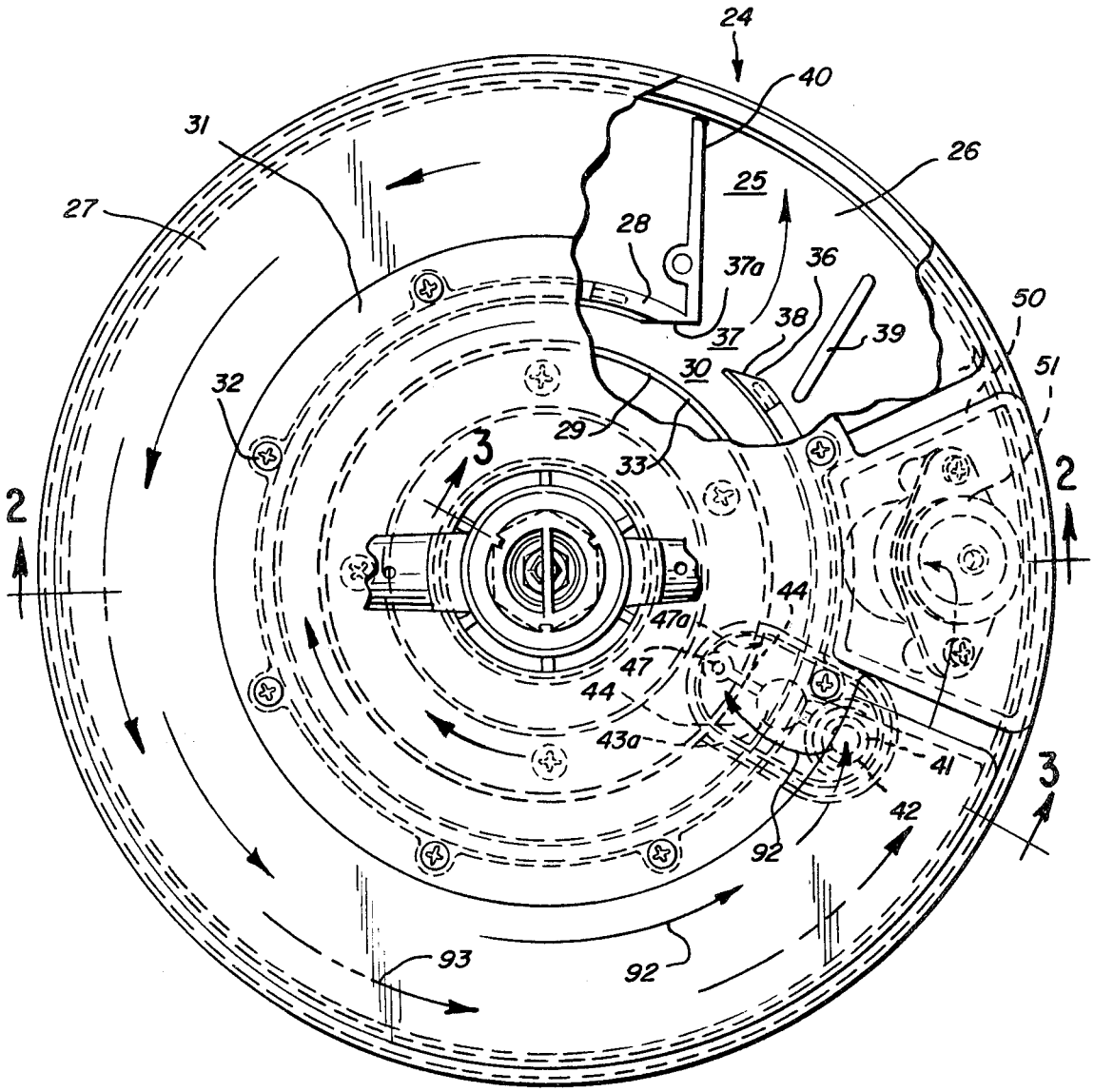
FIG. 1 is a plan view of the dishwasher liquid supply apparatus provided subjacent the spray arm of the dishwasher and with a portion of the cover thereof broken away to illustrate more clearly the flow of a portion of the dishwashing liquid from the guide chamber into the accumulator chamber.

The dishwashing liquid is forced upwardly into the spray arm 14 by a centrifugal pump or recirculation impeller 15 disposed in a pump chamber 16. A pump motor 17 is secured to a drain housing 18 by suitable means, such as bolts 19, and is provided with an output shaft 20 driving a drain pump impeller 21. The shaft 20 extends upwardly from the drain pump for driving the wash pump impeller 15 secured thereto by a retaining bolt 22. Motor 17 comprises a reversible motor. During the dishwashing cycle, the motor rotates in a clockwise direction, as seen in FIG. 1, and thus, wash impeller 15 causes a swirling movement of the dishwashing liquid in pump chamber 16 in a clockwise direction, as well as delivering the dishwashing liquid under a positive pressure to the spray arm 14, as discussed above.

As indicated above, the invention comprehends a novel arrangement of the dishwashing liquid circulating means generally designated 23 which effects an automatic cleansing of the dishwashing liquid during the dishwashing cycles and which subsequently effects an automatic discharge of the soil material collected from the dishwashing liquid in a drain operation wherein the dishwashing liquid is also discharged to a drain. More specifically, the invention comprehends the provision of accumulator chamber means generally designated 24 defining an accumulator chamber 25 in which soil material in the dishwashing liquid is collected during the dishwashing operation. As seen in FIG. 2, the accumulator chamber means 24 is defined by a lower housing 26 and an upper housing 27. Housings 26 and 27 cooperatively define a radially inner wall 28.

As further shown in FIG. 2, housing 26 is provided with an upstanding annular wall 29 radially inwardly of wall 28 so as to define therebetween an annular guide chamber 30. A cover 31 is secured to the top of upper housing 27 by suitable means, such as screws 32. An upper edge 33 of wall 29 is spaced below the cover 31 so as to define therebetween a flow passage 34. Cover 31 further defines a depending annular wall 35 extending downwardly to below the level of the upper edge 33 of wall 29 so that dishwashing liquid must first flow upwardly into flow passage 34, across the top edge 33, and downwardly into the guide chamber 30, as indicated by the arrows in FIG. 2.

Pump impeller 15 is provided with a plurality of blades 36 which are rotated about the axis of the motor shaft 20, so as to discharge the dishwashing liquid being pumped thereby with a swirling movement. Resultingly, the liquid passing through flow passage 34 is caused to have a swirling movement so as to resultingly flow in an annular path through the annular guide chamber 30. Referring now more specifically to FIG. 1, in a preselected position, wall 28 is provided with an opening 37 having edges **37*a* and 38 extending chordally to the annular extent of guide chamber 30 so as to guide a portion of the annularly moving dishwashing liquid outwardly into the accumulator chamber 25. Thus, opening 37** effectively defines a radially inner inlet opening to the accumulator chamber.

Adjacent opening 37, the accumulator chamber is provided with a vertically extending deflector wall 39 which, as seen in FIG. 1, acts to reverse the direction of annular flow of the liquid passing through the inlet opening 37 so that this portion of the dishwashing liquid is then directed in a counterclockwise annular flow through the annular accumulator chamber 25.

As further shown in FIG. 1, adjacent edge **37*a* of the inlet opening 37, the accumulator chamber is provided with a weir 40 upstanding from lower housing portion 26 and generally transversely across the lower portion of the accumulator chamber 25 defined by the lower housing 26. Thus, the portion of the dishwashing liquid flowing into the lower portion of the accumulator chamber through opening 37 is caused to have a reduced velocity of flow as it enters the larger cross-sectional area chamber 24. Deflecting wall 39 and weir 40 combine to straighten the spiral effect of the liquid flowing into chamber 25**, thus reducing turbulence within the accumulator channel. Resultingly, soil matter, such as food particles, carried by the dishwashing liquid is caused to settle out from the flowing dishwashing liquid and collect in the lower portion of the accumulator chamber during the dishwashing cycle.

Figure 3:
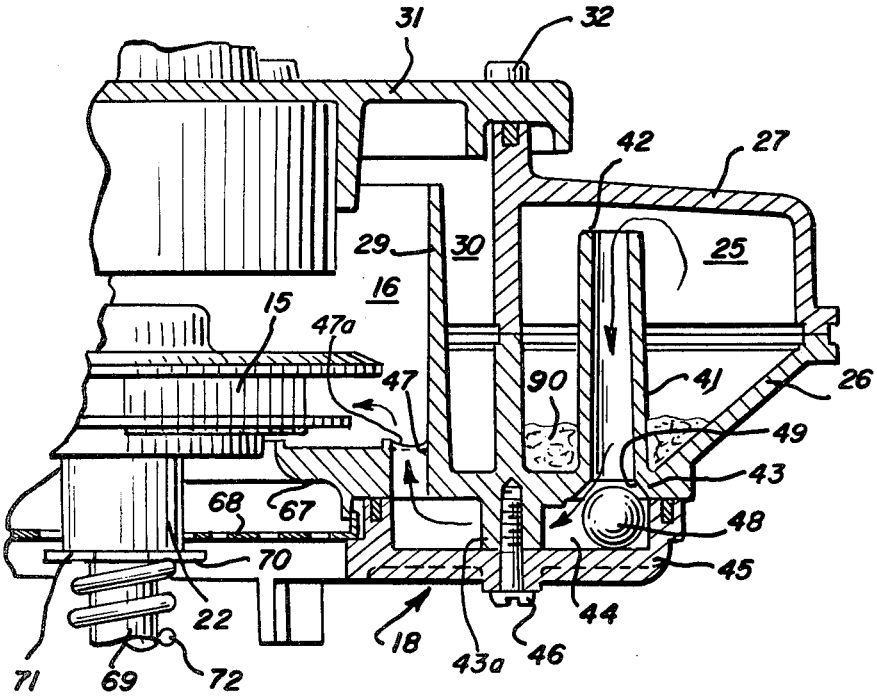
FIG. 3 is a fragmentary enlarged section taken substantially along the line 3—3 of FIG. 1, illustrating the means for returning the cleansed dishwashing liquid to the pump chamber.

The thusly cleansed dishwashing liquid is returned to the pump chamber to be repumped with additional dishwashing liquid by the pump impeller 15. The return passage from the accumulator chamber 25 to the pump chamber 16 is defined by a tubular outlet wall 41, as shown in FIG. 3, having an upper end 42 opening to an upper portion of the accumulator chamber 25. The lower end of the tubular wall 41 opens through a bottom wall 43 of the housing 26 and into a transfer passage 44 defined by a portion 45 of the drain housing 18. As shown in FIG. 3, the drain housing portion 45 may be secured to the bottom wall 43 by suitable means such as a screw 46 which is secured in a boss 43*a*, integral with bottom wall 43. As seen in FIG. 1, passage 44 extends around boss 43*a* and communicates with a return inlet opening 47.

As shown in FIGS. 1 and 3, the return inlet opening 47 from the transfer passage 44 is turned upwardly therefrom to open into pump chamber 16 adjacent wall 29 at the periphery of the pump impeller 15. A ramp 47*a* surrounding a portion of opening 47 helps create a low pressure zone at opening 47 during the clockwise rotation of impeller 15 to increase the flow rate of liquid through the accumulator.

As further illustrated in FIG. 3, means may be provided for preventing backflow of dishwashing liquid through passages 47 and 44 into the outlet 41 of the accumulator chamber and, more specifically, a ball 48 is provided in transfer passage 44 to seat on an annular seat 49 defined by the lower end of the tubular outlet wall 41 facing the transfer passage 44.

The collector soil designated at 90 is retained in the lower portion of the accumulator chamber while the cleansed liquid disposed in the upper portion thereof is transferred through outlet 41 and passage 44 to the pump chamber.

As shown in FIG. 1, accumulator chamber 25 is closed adjacent deflector 39 by a transverse end wall 50. Outlet 41 is spaced in a clockwise direction from end wall 50 and downstream of the outlet. Intermediate the outlet and end wall 50, the accumulator chamber is provided with a drain 51 which is normally closed during the dishwashing cycle. Referring to FIG. 2, drain 51 is defined by a drain opening 52 in bottom wall 43 of the housing 26, which is selectively closed by a movable valve member 53 disposed in a drain chamber 54 of the drain housing 18.

As shown in FIG. 2, the drain opening 52 is frustoconical, widening toward the drain chamber 54 and the valve member 53 is frustoconical narrowing toward drain opening 52 so as to have a seated relationship with the portion of the bottom wall 43 defining the drain opening 52 when the valve member is moved upwardly into the drain opening.

Movement of the valve member 53 is effected by a stem 55 carrying the valve member on its lower end, and having an upper connector 56 secured to a flexible diaphragm 57. The backside of the diaphragm is provided with a spring retainer 58 receiving a coil spring 59 compressed between the spring retainer and a cap 60 secured to an annular portion 61 of the housing 27. As shown, cap 60 is provided with a vent opening 62 which opens at a space 63 under an apron 64 projecting from the cover 31. Space 63 is open to atmosphere and, thus, the backside of diaphragm 57 is normally maintained at atmospheric pressure.

During the normal dishwashing cycle, the flow of dishwashing liquid into the accumulator chamber provides a sufficient pressure on the liquid therein so as to urge the diaphragm 57 upwardly against the biasing action of spring 59, thereby seating valve member 53 in the opening 52 and closing the drain. At the same time, the drain pump impeller 21 is being rotated in a clockwise direction together with the wash pump impeller 15 and, thus, tends to urge liquid in a clockwise direction in the drain pump chamber 65 illustrated in FIG. 4. As shown in FIG. 4, chamber 54 opens chordally into chamber 64 so as to receive a portion of the liquid being swirled by the drain pump in the clockwise direction. This liquid then acts on the bottom of the valve member 53 to augment the closing action of the diaphragm 57 on the valve member, thereby effectively assuring a closed condition of the drain during the normal dishwashing cycle.

As further illustrated in FIGS. 2 and 4, the outlet from drain housing 18 is through a drain port 66 which opens downwardly through the bottom of the housing 18, in substantially parallel relationship to the drain passage 54 (FIG. 4).

When it is desired to drain the dishwashing liquid at the completion of a dishwashing cycle, the motor is stopped to allow the pressure in chamber 25 to drop sufficiently to allow biasing spring 59 to unseat valve member 53. The connections to electric motor 17 are then reversed so as to cause counterclockwise operation thereof with concomitant counterclockwise rotation of the wash pump impeller 15 and the drain pump impeller 21. The resultant counterclockwise swirling flow of the dishwashing liquid in the pump chamber causes the annular flow of the dishwashing liquid portion in the guide chamber 30 to flow in a counterclockwise direction past the inlet opening 37. Such counterclockwise flow past the opening does not provide a substantial flow of the dishwashing liquid into the inlet opening and, thus, the pressure of the dishwashing liquid in accumulator chamber 25 remains relatively low, allowing spring 59 of the drain valve to hold the drain valve in the open condition illustrated in FIG. 2.

At the same time, the counterclockwise rotation of the drain pump, as seen in FIG. 4, causes a counterclockwise flow of the drain liquid in the chamber 65 past the opening of passage 54 to the chamber so as to provide a negative pressure in the drain chamber 54, further tending to move the valve member 53 to the open position of FIG. 2. Resultingly, dishwashing liquid flows during the drain cycle through the inlet 37 into the accumulator chamber 25, past the tubular outlet wall 41 and outwardly through the drain opening 52 to carry with it the accumulated soil 90 and discharge the liquid with the soil carried therein through the drain port 66 to a suitable drain. As the drain opening 52 is in the bottom portion of the accumulator chamber, the flow efficiently washes the collected soil 90 outwardly through the drain opening 52 in providing a self-cleaning of the chamber during the drain cycle.

Figure 6:
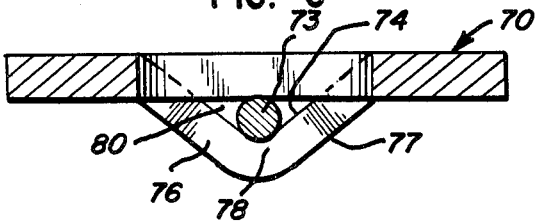
FIG. 6 is an enlarged transverse section taken substantially along the line 6—6 of FIG. 5.

Referring now to FIG. 3, extending across an inlet 67 to pump chamber 16 is a filter screen 68. Portion 69 of the shaft 20 between drain pump impeller 21 and wash pump impeller 15 extends through screen 68 and is provided subjacent the screen with a chopper 70. As shown in FIG. 5, the chopper comprises a blade element, and as illustrated in FIG. 3, the chopper blade is urged against a downwardly facing shoulder 71 on impeller 15 by a coil spring 72. As shown in FIGS. 2 and 4, the upper distal end 73 of the coil spring extends radially outwardly into a V-shaped groove 74 in a radial tongue 75 of the chopper and a lower distal end 78 of the coil spring extends into and is driven in rotation by a blind hole 21*a* in impeller 21. As illustrated in FIG. 6, the groove 74 is defined by a pair of integrally connected deformed wall portions 76 and 77. Resultingly, an opening 80 is provided through which the spring end 73 may extend radially outwardly.

As shown in FIG. 5, a hub or center portion 79 of chopper 70 is provided with a circular bore 81 allowing rotational movement of the chopper with respect to the shaft portion 69.

As further shown in FIG. 5, a turned blade 82 extends radially outwardly from the center portion 79 and is provided with a cutting edge 83 for comminuting soil particles that are trapped on the filter screen so that they may subsequently readily pass through the screen openings.

Figure 7:
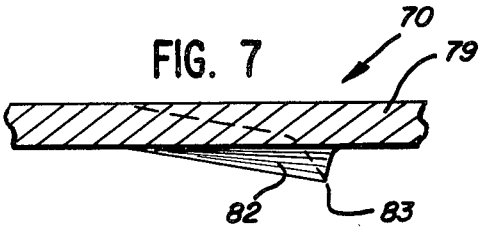
FIG. 7 is a fragmentary transverse section taken substantially along the line 7—7 of FIG. 5.

The resilient drive and mounting of the chopper by means of spring 72 provides an improved chopping action. As shown in FIGS. 5 and 7, the blade 82 is turned from the flat plane of midportion 79 to create turbulence in the liquid adjacent the bottom of the filter screen, facilitating free movement of the soil particles and effectively precluding them from being retained in blocking disposition in the screen openings. Thus, the chopper defines means for effecting self-cleaning of the screen both in comminuting large particles and in causing turbulence in the liquid adjacent the bottom surface to provide a washing action.

In brief recapitulation, the liquid circulating means of dishwasher apparatus 10 provides an improved self-cleaning function in the operation of the apparatus. As shown in FIG. 2, the wash liquid enters the centrifugal pump recirculation impeller 15 as illustrated by broken arrows 91 from the wash chamber 12. That liquid is pumped in a swirling motion by the clockwise rotation of the impeller 15 to the spray arm 14. As the liquid is pumped, the motion imparted to the liquid causes the soil particles to be centrifugally forced outwardly toward annular wall 29. That portion of the liquid containing the soil particles flows over the wall 29, into guide chamber 30 and through the accumulator chamber 25 for cleansing of the liquid and back to pump impeller 15 as illustrated by the solid arrows 92 (FIGS. 1, 2 and 3). The pressure in chamber 25 during a dishwashing operation closes the drain opening 52 by movement of valve member 53 into the opening. By reversing the direction of rotation of the motor 17, the impellers 15 and 21 are reversed to counterclockwise rotation, opening drain opening 52 and causing the liquid flow through the accumulator chamber 25 to wash out the soil particles for flow through the drain pump chamber 65 and out drain port 66 as illustrated in FIG. 4 by the partially broken arrows 93. The soil accumulator is arranged in a compact manner about the wash pump for improved facilitated cleansing of the dishwashing liquid during the dishwashing cycle. Improved means are provided for removing the collected soil material in the drain operation following completion of the dishwashing operation. An improved chopper means is provided for further improving the recirculation of the dishwashing liquid and effecting an improved dishwashing operation.

The apparatus of the present invention is extremely simple and economical of construction while yet providing the highly desirable improved functioning discussed above.

The foregoing disclosure of specific embodiments is illustrative of the broad inventive concepts comprehended by the invention.

We claim:

1. In a soil separator for use in a dishwasher having wall means defining a pump chamber, a liquid impeller in said chamber, an inlet opening to said chamber, and a generally flat filter screen extending across said inlet to prevent passage of solid matter of a size greater than a preselected size to said chamber, an improved chopper for chopping such large size solid matter caught by the screen to reduce it to a size permitting passage through the screen with the liquid being drawn through said screen by the impeller, said chopper comprising:

a hub;

means for rotating said hub closely adjacent the upstream side of the screen about an axis perpendicular to said screen; and a chopping blade carried by the hub and defining a cutting edge extending outwardly from the hub substantially parallel to said screen, said blade being turned relative to a plane parallel to said screen to define means for causing turbulent agitation of the liquid immediately upstream of the screen for preventing adherence of the large size solid material to the upstream side of the screen, whereby said cutting edge chops the large size food particles caused to be agitated by said turned blade as it is swung annularly about said axis by the rotating hub.

2. The soil separator of claim 1 wherein said blade is substantially planar.

3. The soil separator of claim 1 wherein said hub comprises a flat disc and said cutting edge is spaced from the plane of the disc.

4. The soil separator of claim 1 wherein said blade extends radially to said axis.

5. The soil separator of claim 1 wherein said means for rotating said hub comprises a drive shaft and means for yieldably mounting the hub to said drive shaft.

6. In a soil separator for use in dishwashers and the like having wall means defining a pump chamber, a liquid impeller in said chamber, an inlet opening to said chamber, and a generally flat filter screen extending across said inlet to prevent passage of solid matter of a size greater than a preselected size to said chamber, an improved chopper for chopping such large size solid matter caught by the screen to reduce it to a size permitting passage through the screen with liquid being drawn through said screen by the impeller, said chopper comprising:

a hub;

a drive shaft driven rotatively about an axis perpendicular to said screen;

means for yieldably mounting said hub to said drive shaft for rotation therewith closely adjacent the upstream side of the screen; and a chopping blade carried by the hub and defining a cutting edge extending outwardly from the hub substantially parallel to said screen, said blade being turned relative to a plane parallel to said screen to define means for causing turbulent agitation of the liquid immediately upstream of the screen for preventing adherence of large size solid material to the upstream side of the screen, whereby said cutting edge chops the large size food particles caused to be agitated by said turned blade as it is swung annularly about said axis by the rotating hub, and whereby yieldable mounting of the hub to the drive element effectively reducing shock forces tending to break the blade resulting from impact of the blade with hard solid matter to be cut thereby.

7. The soil separator of claim 6 wherein said means for yieldably mounting the hub element to the drive element comprises a coil spring disposed coaxially of the drive element and having a connecting portion connected to said hub.

8. The soil separator of claim 6 wherein said hub is provided with means defining an outwardly extending groove and said means for yieldably mounting the hub element to the drive element comprises a coil spring disposed coaxially of the drive element and having an end portion retained in said groove.

9. The soil separator of claim 6 wherein said hub is provided with means defining an outwardly extending groove and said means for yieldably mounting the hub element to the drive element comprises a coil spring disposed coaxially of the drive element and having an end portion retained in said groove, said groove being defined by a tongue extending outwardly from said hub, and said groove opening at its inner end to the space adjacent one face of the hub.

10. The soil separator of claim 6 wherein said hub is provided with means defining an outwardly extending V-shaped groove and said means for yieldably mounting the hub element to the drive element comprises a coil spring disposed coaxially of the drive element and having an end portion retained in said groove.

11. The soil separator of claim 6 wherein said means for yieldably mounting the hub element to the drive element comprises means providing an angularly tippable mounting of the hub to the drive element.

12. The soil separator of claim 6 wherein said means for yieldably mounting the hub element to the drive element comprises resiliently yieldable means including an upper distal end connected to said hub and a lower distal end driven by said drive shaft.

* * * * *